US005385374A

United States Patent [19]

Fann et al.

[11] Patent Number: 5,385,374

[45] Date of Patent: Jan. 31, 1995

[54] REINFORCED CYLINDRICAL DOOR LOCK SET

[75] Inventors: Yaw-Shin Fann, Chiayi; San-Yi Lin, Yun-Lin Hsien; Rong-Faa Wu, Chiayi Hsien; Ching-Chuan Kuo, Chiayi Hsien; Lan-Kun Don, Chiayi Hsien, all of Taiwan, Prov. of China

[73] Assignee: Tong-Lung Metal Industry Co., Ltd., Chiayi, Taiwan, Prov. of China

[21] Appl. No.: 80,365

[22] Filed: Jun. 21, 1993

[51] Int. Cl.[6] ..... E05B 3/00

[52] U.S. Cl. ..... 292/336.3; 292/348; 292/351; 292/356; 292/DIG. 53; 70/224; 70/417

[58] Field of Search ..... 292/350, 351, 336.3, 292/1.5, 347, 348, 356, 357, DIG. 53, DIG. 54, DIG. 61; 70/209, 224, 379 R, 380, 416, 417, 452, 461, 466, DIG. 31

[56] References Cited

U.S. PATENT DOCUMENTS

| | | | |
|---|---|---|---|
| 4,338,804 | 7/1982 | Solovieff | 70/417 X |
| 4,852,922 | 8/1989 | Shih | 292/336.3 |
| 4,921,289 | 5/1990 | Shen | 292/336.3 |
| 5,067,758 | 11/1991 | Fann et al. | 292/356 X |
| 5,088,778 | 2/1992 | Lin | 292/336.3 |
| 5,118,152 | 6/1992 | Lin | 292/357 X |
| 5,125,696 | 6/1992 | Robida et al. | 292/DIG. 61 X |
| 5,149,155 | 9/1992 | Caeti et al. | 292/336.3 |
| 5,177,987 | 1/1993 | Shen | 292/336.3 X |
| 5,190,327 | 3/1993 | Lin | 292/348 |
| 5,265,924 | 11/1993 | Kim | 292/336.3 |
| 5,284,372 | 2/1994 | Lin | 292/336.3 |
| 5,286,074 | 2/1994 | Lin | 292/336.3 |

*Primary Examiner*—Peter M. Cuomo
*Assistant Examiner*—Suzanne L. Dino
*Attorney, Agent, or Firm*—Ladas & Parry

[57] ABSTRACT

A cylindrical door lock set includes inner and outer knob supporting plates, a turning mechanism, an annular mounting plate and a latch unit. The outer knob supporting plate has a central hole and an inner side provided with a pair of posts on two sides of the central hole. The posts are hollow and are threaded internally. The turning mechanism is supported on the inner side of the outer knob supporting plate and is provided with a turn shaft. The annular mounting plate is secured on the inner side of the outer knob supporting plate and is formed with a pair of mounting shafts and a central hole to permit the turn shaft of the turning mechanism to extend therethrough. The latch unit is formed with a shaft engaging hole to permit the turn shaft to extend therethrough, and two side holes disposed on two sides of the shaft engaging hole in a lengthwise direction of the latch unit to receive respectively the mounting shafts. The latch unit is disposed between the posts of the outer knob supporting plate. The inner knob supporting plate is formed with a pair of holes which are aligned with the posts. Bolts pass through the holes of the inner knob supporting plate and engage a respective one of the posts.

6 Claims, 3 Drawing Sheets

REINFORCED CYLINDRICAL DOOR LOCK SET

BACKGROUND OF THE INVENTION

1. Field of the Invention

The invention relates to a lock set, more particularly to a reinforced cylindrical door lock set.

2. Description of the Related Art

Referring to FIG. 1, a conventional cylindrical door lock set is shown to comprise an outer door knob (A), an inner door knob (B), a turning mechanism (C), a knob support unit (D) and a latch unit (E). The knob support unit (D) includes inner and outer knob supporting plates (F, G) and a pair of bolts (H). The outer knob supporting plate (G) is formed with a central hole to permit the extension of the turning mechanism (C) therethrough. The outer knob supporting plate (G) has an outer side which is connected to the outer door knob (A). The outer knob supporting plate (G) further has an inner side which is provided with a pair of posts (I) on two sides of the central hole. The posts (I) are hollow and are threaded internally. The inner knob supporting plate (F) is formed with a central hole to permit mounting of the inner door knob (B) on an outer side of the knob supporting plate (F). The inner door knob (B) is formed with an axial hole (not shown) for receiving one end of a turn shaft (K) of the turning mechanism (C). The inner knob supporting plate (F) is further formed with a pair of holes (J) which are aligned with the posts (I). The bolts (H) pass through the holes (J) and engage the posts (I) to retain the inner and outer knob supporting plates (F, G) on two sides of a door.

Note that in order to mount the cylindrical door lock set on the door, the door should be formed with a transverse larger opening (N). A smaller opening is then bored through the door so that the axis of the smaller opening is transverse to that of the larger opening (N). When installing the latch unit (E), the latch unit (E) is inserted into the larger opening (N) via the smaller opening and is secured in place by a pair of screws which pass through a face plate. The latch unit (E) is formed with a shaft engaging hole (M) and side holes (L) on two sides of the shaft engaging hole (M). The side holes (L) permit the extension of the posts (I) of the outer knob supporting plate (G) therethrough so as to align with the holes (J) of the inner knob supporting plate (F), while the shaft engaging hole (M) permits the extension of the turn shaft (K) of the turning mechanism (C) therethrough so as to engage the inner door knob (B). The bolts (H) then pass through the holes (J) and engage the posts (I) to retain the inner and outer knob supporting plates (F, G) on two sides of the door. When one of the outer and inner door knobs (A, B) is turned, the turn shaft (K) of the turning mechanism (C) turns therewith, thereby activating the latch unit (E) so as to permit opening of the door.

Since the cylindrical door lock set is provided on the larger opening (N) of the door, a relatively large space is formed between the inner and outer knob supporting plates (F, G). The cross-sectional size of the posts (I) cannot be increased and is limited by the size of the side holes (L) of the latch unit (E). Therefore, even though the inner and outer knob supporting plates (F, G) are secured tightly on the door by means of the bolts (H), the protection offered by the conventional cylindrical door lock set can be easily overcome by a thief by striking the cylindrical door lock set with a heavy object or by using a wrench to force the rotation of the outer knob supporting plate (G).

SUMMARY OF THE INVENTION

Therefore, the objective of the present invention is to provide a reinforced cylindrical door lock set which can enhance the protection offered thereby so as to overcome the above mentioned drawback that is commonly associated with the prior art.

Accordingly, a cylindrical door lock set of the present invention comprises:

- an outer knob supporting plate having a central hole, an outer side, and an inner side provided with a pair of posts on two sides of the central hole, the posts being hollow and being threaded internally;
- an outer door knob connected to the outer side of the outer knob supporting plate;
- a turning mechanism supported on the inner side of the outer knob supporting plate and provided with a turn shaft;
- an annular mounting plate secured on the inner side of the outer knob supporting plate and formed with a pair of mounting shafts and a central hole to permit the turn shaft of the turning mechanism to extend therethrough;
- a latch unit formed with a shaft engaging hole to permit the turn shaft to extend therethrough, and two side holes disposed on two sides of the shaft engaging hole in a lengthwise direction of the latch unit to receive respectively the mounting shafts, the latch unit being disposed between the posts;
- an inner knob supporting plate having an outer side and being formed with a central hole and a pair of holes which are aligned with the posts;
- an inner door knob connected to the outer side of the inner knob supporting plate in the central hole, the inner door knob engaging one end of the turn shaft; and
- a pair of bolts respectively passing through the holes of the inner knob supporting plate and respectively engaging the posts.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
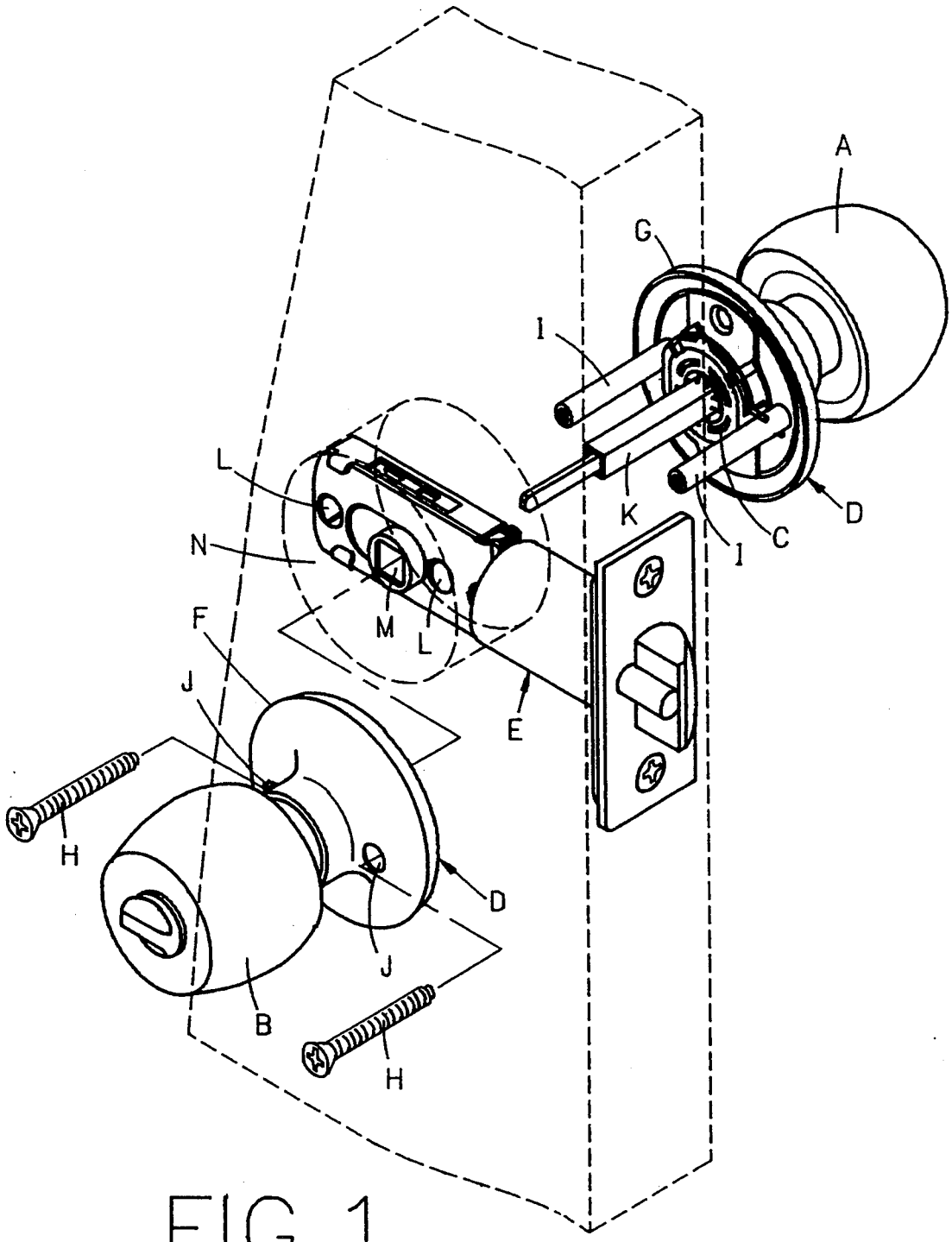
FIG. 1 (PRIOR ART)
FIG. 1 is a partly exploded view illustrating how a conventional cylindrical door lock set is installed.

Before the preferred embodiment is described in greater detail, it should be noted that like elements are indicated by like reference numerals throughout the disclosure.

Figure 2:
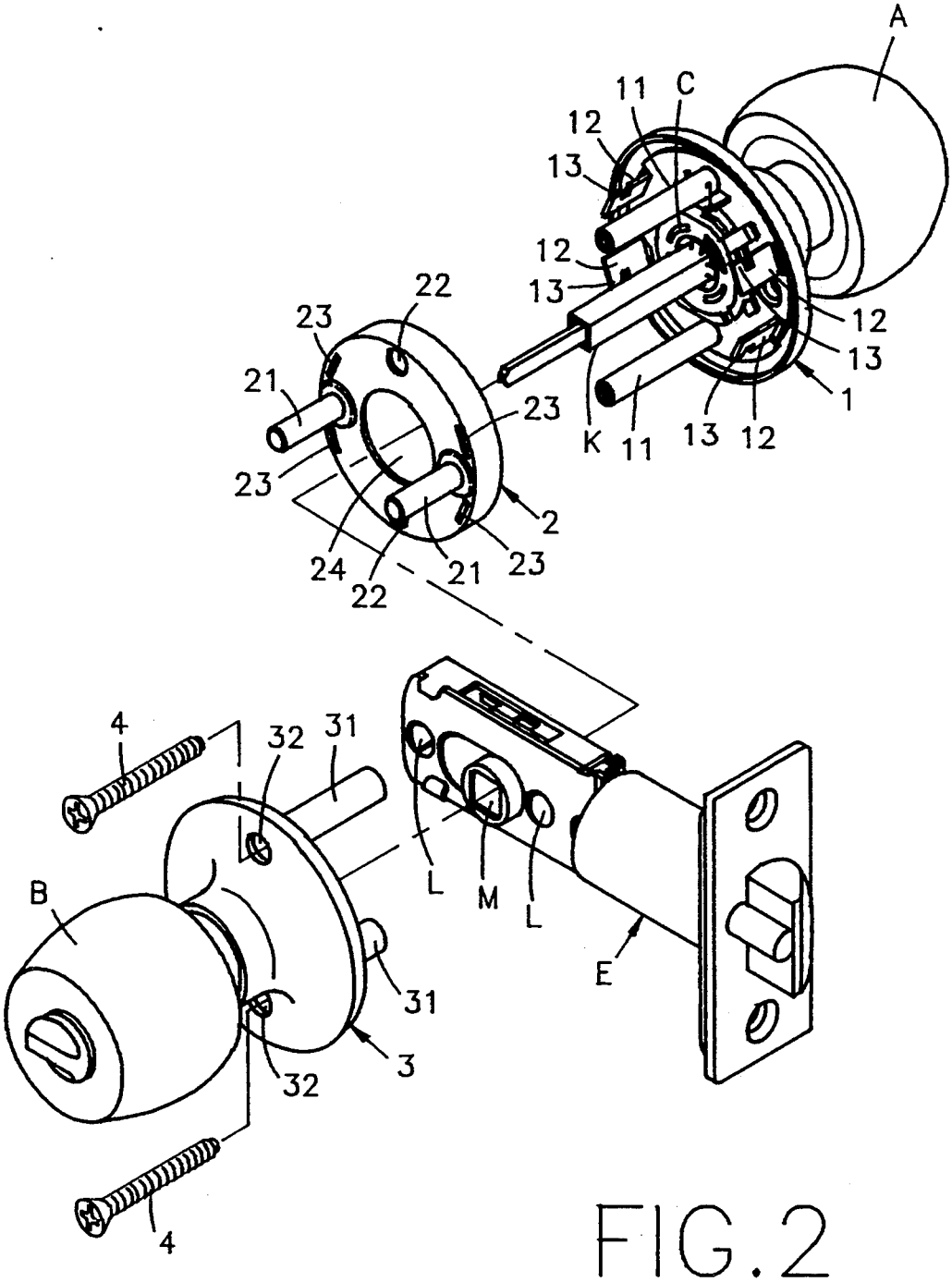
FIG. 2 is an exploded view of the preferred embodiment of a reinforced cylindrical door lock set according to the present invention.
Figure 3:
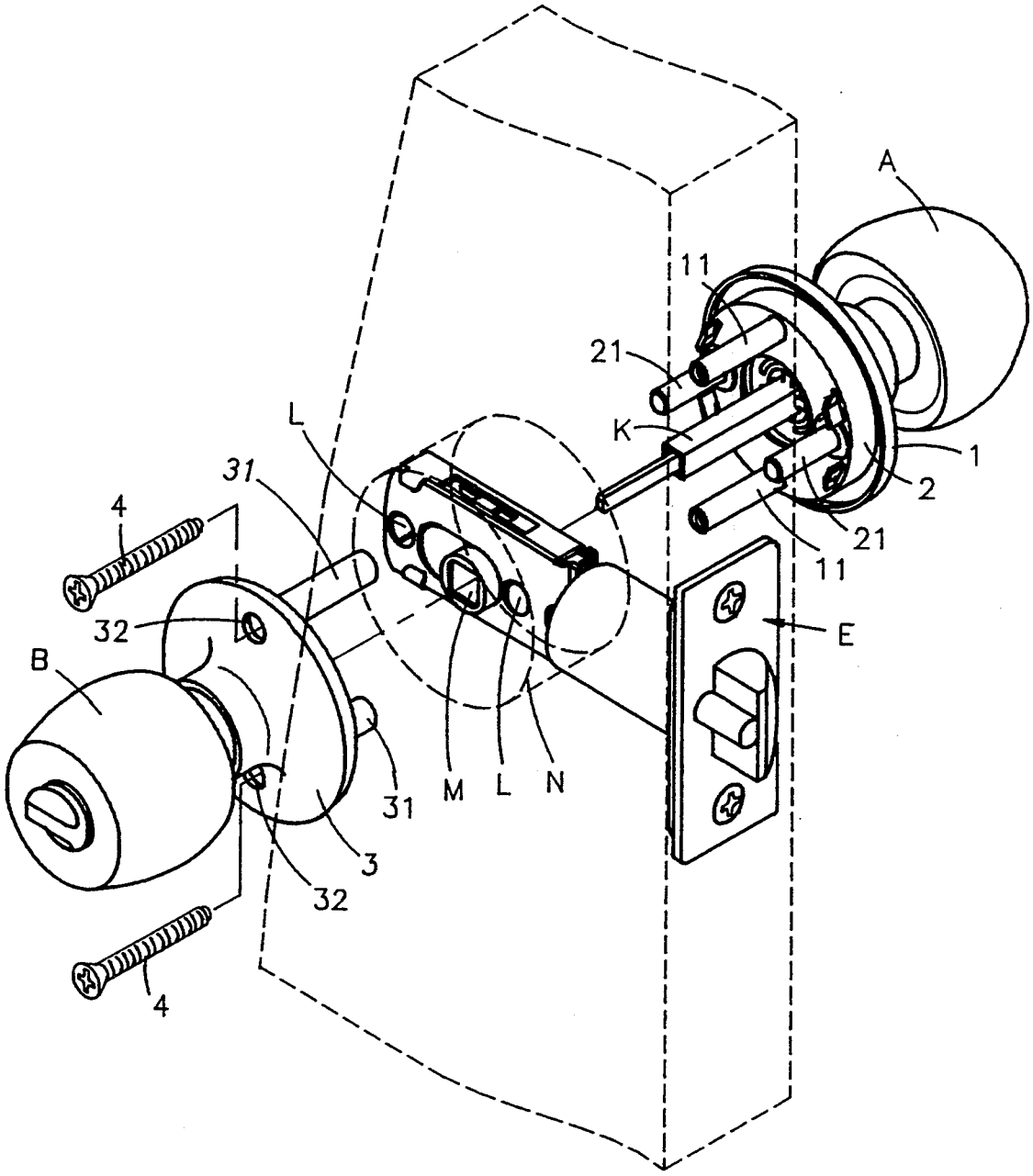
FIG. 3 is a partly exploded view illustrating how the preferred embodiment is installed.

Referring to FIGS. 2 and 3, the preferred embodiment of a reinforced cylindrical door lock set according to the present invention is shown to comprise an outer door knob (A), an inner door knob (B), a turning mechanism (C), a knob support unit and a latch unit (E). The knob support unit includes inner and outer knob supporting plates 3, 1 and a pair of bolts 4. The turning mechanism (C) is supported on an inner side of the outer knob supporting plate 1. The outer knob supporting plate 1 is formed with a central hole to permit the extension of the turning mechanism (C) therethrough. The outer knob supporting plate 1 further has an outer side which is connected to the outer door knob (A), a pair of posts 11 provided on the inner side of the knob supporting plate 1 on two sides of the central hole and four transverse plate projections 12 similarly provided on the inner side of the knob supporting plate 1. The posts 11 are hollow and are threaded internally. Each of the plate projections 12 has a distal foldable portion 13.

The cylindrical door lock set further includes an annular mounting plate 2. The mounting plate 2 is formed with a pair of mounting shafts 21, four slots 23 which are respectively aligned with the plate projections 12, and two through holes 22 which are respectively aligned with the posts 11 of the outer knob supporting plate 1. The mounting plate 2 is secured on the inner side of the outer knob supporting plate 1 such that the plate projections 12 extend respectively through the slots 23 and such that the posts 11 extend respectively through the through holes 22. The foldable portions 13 are bent afterwards in order to prevent the untimely removal of the mounting plate 2 from the outer knob supporting plate 1. The mounting shafts 21 correspond with the side holes (L) of the conventional latch unit (E) and extend through the same when the cylindrical door lock set is installed on a door. The mounting plate 2 further has a central hole 24 to permit the turn shaft (K) of the turning mechanism (C) to extend through the shaft engaging hole (M) of the latch unit (E) so as to connect with the inner door knob (B).

The inner knob supporting plate 3 is formed with a central hole, and the inner door knob (B) is connected to an outer side of the inner knob supporting plate 3 in the central hole. The inner door knob (B) is formed with an axial hole (not shown) to receive one end of the turn shaft (K) of the turning mechanism (C). The inner knob supporting plate 3 is further formed with a pair of holes 32, which are aligned with the posts 11, and a pair of tubular sleeves 31 which extend from an inner side of the inner knob supporting plate 3 around a respective one of the holes 32. The bolts 4 respectively pass through the holes 32 and respectively engage the posts 11 to retain the inner and outer knob supporting plates 3, 1 on two sides of a door.

Referring once more to FIG. 3, the latch unit (E) is installed on the door in a conventional manner. The turn shaft (K) of the turning mechanism (C) extends into the opening (N) that is formed in the door in order to extend through the shaft engaging hole (M) of the latch unit (E). Note that the side holes (L) of the latch unit (E) are disposed on two sides of the shaft engaging hole (M) in a lengthwise direction of the latch unit (E). The mounting shafts 21 on the mounting plate 2 extend through the opening (N) in order to extend fittingly into the respective side hole (L). Since the posts 11 are at right angles with the mounting shafts 21, the latch unit (E) is disposed between the posts 11 at this stage. The tubular sleeves 31 of the inner knob supporting plate 3 are sleeved on the respective one of the posts 11 of the outer knob supporting plate 1, and the bolts 4 then pass respectively through the holes 32 and engage respectively the posts 11 to retain the inner and outer knob supporting plates 3, 1 on the door on two sides of the latch unit (E).

Since the mounting shafts 21 of the mounting plate 2 extend through the side holes (L) of the latch unit (E), and since the tubular sleeves 31 of the inner knob supporting plate 3 are sleeved respectively on the posts 11 of the outer knob supporting plate 1, the cylindrical door lock set of the present invention is capable of resisting a much larger torque than the prior art. Furthermore, since the tubular sleeves 31 of the inner knob supporting plate 3 are sleeved on the respective one of the posts 11 of the outer knob supporting plate 1 during assembly, proper relative positioning of the inner and outer knob supporting plates 3, 1 can be easily achieved, thereby facilitating installation of the cylindrical door lock set of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A cylindrical door lock set, comprising:

an outer knob supporting plate having a central hole, an outer side, and an inner side provided with a pair of posts on two sides of said central hole, said posts being hollow and being threaded internally;

an outer door knob connected to said outer side of said outer knob supporting plate;

a turning mechanism supported on said inner side of said outer knob supporting plate and provided with a turn shaft;

an annular mounting plate secured on said inner side of said outer knob supporting plate and formed with a pair of mounting shafts and a central hole to permit said turn shaft of said turning mechanism to extend therethrough;

a latch unit formed with a shaft engaging hole to permit said turn shaft to extend therethrough, and two side holes disposed on two sides of said shaft engaging hole in a lengthwise direction of said latch unit to receive respectively said mounting shafts, said latch unit being disposed between said posts;

an inner knob supporting plate having an outer side and being formed with a central hole and a pair of holes which are aligned with said posts;

an inner door knob connected to said outer side of said inner knob supporting plate in said central hole, said inner door Knob engaging one end of said turn shaft; and a pair of bolts respectively passing through said holes of said inner knob supporting plate and respectively engaging said posts.

2. The cylindrical door lock set as claimed in claim 1, wherein said posts are at right angles with said mounting shafts.

3. The cylindrical door lock set as claimed in claim 1, wherein:

said inner side of said outer knob supporting plate is further provided with a plurality of transverse plate projections; and said mounting plate is further formed with a plurality of slots which are respectively aligned with said plate projections to permit said plate projections to extend therethrough.

4. The cylindrical door lock set as claimed in claim 3, wherein each of said plate projections has a distal foldable portion which is Dent after said plate projections have been extended through said slots to prevent untimely removal of said mounting plate from said outer knob supporting plate.

5. The cylindrical door lock set as claimed in claim 1, wherein said inner knob supporting plate further has an inner side and a pair of tubular sleeves which extend from said inner side of said inner knob supporting plate around a respective one of said holes of said inner knob supporting plate and which are sleeved respectively on said posts of said outer knob supporting plate.

6. The cylindrical door lock set as claimed in claim 1, wherein said annular mounting plate is further formed with two through holes which permit respectively said posts of said outer knob supporting plate to extend therethrough.

* * * * *